United States Patent [19]

Rigal

[11] Patent Number: 4,799,655

[45] Date of Patent: Jan. 24, 1989

[54] APPARATUS FOR ADAPTING A CONVENTIONAL TEMPLATE FOR USE IN MOUNTING BINDINGS TO A MONOSKI

[75] Inventor: Jean-Pierre Rigal, Mesegny, France

[73] Assignee: Salomon S.A., Annecy Cedex, France

[21] Appl. No.: 63,991

[22] Filed: Jun. 19, 1987

[30] Foreign Application Priority Data

Jun. 27, 1986 [FR] France ..... 86 09369

[51] Int. Cl.[4] ..... B25B 3/00

[52] U.S. Cl. ..... 269/2; 269/906; 269/87.3

[58] Field of Search ..... 269/1, 2, 87.3, 294, 269/295, 906; 33/562, 563, 666, 669, 677, 679, 574, 577, 578; 408/103, 115 R, 115 B, 72 B, 3; 24/563, 545, 556

[56] References Cited

U.S. PATENT DOCUMENTS

| | | | |
|---|---|---|---|
| 3,076,242 | 2/1963 | Priolo | 24/563 |
| 3,082,897 | 3/1963 | Highley | 24/556 |
| 3,089,211 | 5/1963 | Perusse | 24/556 |
| 3,104,473 | 9/1963 | Rose | 24/563 |
| 4,065,114 | 12/1977 | Pennington | 269/2 |
| 4,131,040 | 12/1978 | Bollmer | 269/87.3 |
| 4,538,354 | 9/1985 | Smolik | 408/72 B |
| 4,605,978 | 8/1986 | Zeavin | 24/563 |

FOREIGN PATENT DOCUMENTS

| | | |
|---|---|---|
| 0371013 | 5/1983 | Austria . |
| 2360935 | 7/1975 | Fed. Rep. of Germany . |
| 2240751 | 3/1973 | France . |
| 2511906 | 3/1983 | France . |

*Primary Examiner*—Robert C. Watson
*Attorney, Agent, or Firm*—Sandler & Greenblum

[57] ABSTRACT

An adaptation device 10 for temporary positioning of a conventional ski template on a monoski including a plate 12 having two parallel edges 16*a* and 16*b* separated by a distance substantially equal to the width of a conventional ski, a lower contact surface 20 and gripping arm 22 for temporarily immobilizing the plate on the upper surface of the monoski by abutting an interior surface 22*e* against a lateral side 31*a* of the monoski and by gripping the thickness of the monoski adjacent one of its lateral edges in such a fashion that the parallel edges of the adaptation element extend in a longitudinal direction of the monoski.

5 Claims, 4 Drawing Sheets

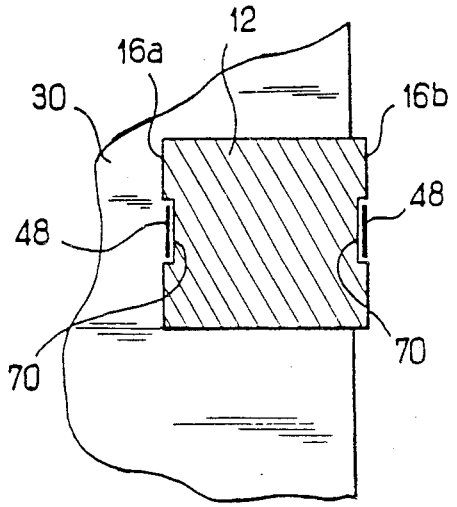
FIG_6
FIG.7
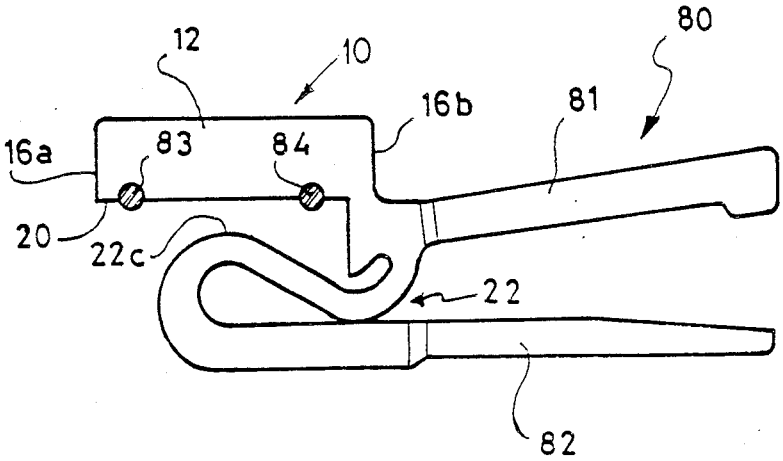

APPARATUS FOR ADAPTING A CONVENTIONAL TEMPLATE FOR USE IN MOUNTING BINDINGS TO A MONOSKI

BACKGROUND OF THE INVENTION

1. Field of the Invention

The present invention relates to equipment for use in connection with skis and particularly Alpine skis. More specifically, the present invention is directed to equipment used during procedures for mounting sets of bindings for shoes or boots on skis of the "monoski" type.

2. Discussion of Background and Material Information

In the course of mounting front and rear bindings adapted for positioning and maintaining ski boots on the upper surface of a conventional ski, one generally begins by temporarily placing a template, having a predetermined arrangement of bores for determining the location of holes to be drilled in the ski, on the ski at a predetermined position designated by reference lines. Such a template includes a plate extending along the length of a portion of the upper surface of the ski provided with a group of openings or bores provided at well-defined positions through which one inserts a drill or other means for boring holes of a predetermined depth and diameter in the ski. The template is then removed and the front and rear bindings are positioned and secured to the ski by means of screws engaged in these holes to mount the binding on the ski.

A template of this type is described in French Pat. No. 2 240 751 and in French Utility Certificate No. 2 511 906, commonly owned with the present application. In addition to the previously mentioned plate provided with openings and reference designations for the correct positioning of these openings in the longitudinal direction of the ski, the templates include two grips provided in front and to the rear, respectively, of the plate for the temporary attachment of the template to the ski. These grips cooperate by gripping the lateral edges of the ski.

This type of temporary affixation of the template is adapted to a very specific ski width, which is considerably narrower than a monoski. Accordingly, conventional templates of this type cannot be used to mount sets of bindings on monoskis. Although a monoski often assumes the shape of an ordinary ski, it should be noted that the width of a monoski is approximately twice as large as the width of an ordinary cross-country or downhill ski, and that the two boots of the user are positioned side-by-side on the monoski by means of two juxtaposed sets of bindings. Thus, because of the substantial width of the monoski, conventional templates cannot be used with monoskis without modification.

Therefore, prior to the present invention, the only technique for mounting bindings to monoskis required determining the position of the holes for the screws manually by tracing directly onto the upper surface of the ski. As one can appreciate, however, this method is long, fastidious, and relatively imprecise.

SUMMARY OF THE INVENTION

The present invention is, therefore, directed to an apparatus for adapting a template normally used to mount bindings on a relatively narrower downhill-type, ordinary ski for the temporary positioning on a wider monoski for purposes of marking positions of mounting screws of a set of bindings which includes: a plate having two parallel edges separated by a distance substantially equal to a width of such an ordinary ski; and means for immobilizing the plate on an upper surface of the monoski adapted to abut against a lateral side of the monoski and grip a thickness in the region of the lateral side of the monoski, preferably wherein the parallel edges extend in the longitudinal direction of the monoski, and wherein the means for immobilizing is composed of an elastically deformable arm extending beneath the plate from one of the parallel edges cooperating with a lower surface of the plate to effect a gripping action, preferably wherein the elastically deformable arm has a contact region provided with an anti-slip means located between the arm and the lower surface of the plate.

In accordance with the present invention, the deformable arm includes a vertical section extending downwardly from one of the edges of the plate which has an interior surface adapted to abut against the side of the monoski for the positioning of the apparatus in a transverse direction with respect to the longitudinal direction of the monoski.

The apparatus for adapting the template for mounting bindings to monoskis in accordance with the present invention, as described above, also includes means for adjusting the position of the plate in the transverse direction with respect to a lateral side of a monoski, wherein the plate includes an upper plate element and a lower plate element and the means for adjustment includes: a removable assembly having ribs on a lower surface of the upper plate element and grooves on an upper surface of the lower plate element which are complementary and of constant pitch and extend parallel to the parallel edges; a guide in the upper plate element extending in a direction perpendicular to the ribs and the grooves; and means for tightening the upper plate element against the lower plate element; in addition to means for positioning the plate in the transverse direction with respect to a monoski.

The present invention is also directed to an apparatus for adapting a template for use in mounting bindings on a monoski, as described above, wherein the means for positioning includes a screw received in a transverse tap hole formed in a vertical portion of the arm at a level to permit the screw to abut against a side of the monoski.

Another embodiment of the apparatus for adapting a template for use in mounting bindings to a monoski, as described above, includes providing the parallel edges of the plate with recesses for receiving tightening elements attached to the template.

Another further embodiment of the apparatus for adapting a conventional template for use in mounting bindings to a monoski, as described above, also includes a grip having two levers connected to the plate and to the arm such that squeezing the levers together causes a spacing of the arm with respect to the plate.

In addition to the foregoing features of the apparatus for adapting a conventional template for use in connection with mounting bindings on a monoski, as described above, the present invention is directed to a method for mounting a set of bindings for boots on a monoski which involves the steps of: immobilizing at least one such adaptation device or apparatus, as described above, on an edge of a monoski at a predetermined position in a longitudinal direction from another such adaptation device; mounting a template for a conventional ski on a plate of the adaptation device which includes a horizontal plate provided with openings and end tightening means, wherein the end tightening means act on the parallel edges of the plate; scoring an upper surface of the monoski through at least some of the openings; removing the template and the adaptation device from the monoski; providing holes of a given diameter and depth in the upper surface of the monoski; and positioning and maintaining a set of bindings secured in the holes to the monoski.

An object of the present invention, therefore, is to provide an apparatus for positioning a template on a ski which includes means for supporting a template, i.e., a support, having an upper surface, a lower surface and an outer side surface; and means for fastening the support on the ski attached to the support, preferably wherein the means for fastening includes a connecting section attached to the outer side surface of the support, which has an exterior surface substantially coplanar with at least a portion of the outer side surface of the support, or alternatively wherein the connecting section has an exterior surface in a first plane and the outer side surface of the support is in another plane essentially perpendicular and offset a distance from the first plane, and the support has an inner side surface opposite the outer side surface and the outer side surface is offset towards the inner side surface.

Another object of the present invention is an apparatus for positioning a template on a ski, as described above, which also includes means for adjusting the position of the support in a direction transverse to a longitudinal axis of the template, wherein the connecting section is essentially perpendicular with respect to the support, and is provided with a transverse opening, and the means for adjusting includes an elongate member adapted to extend through the opening and contact a side of the ski when the apparatus is fastened on the ski, preferably wherein the opening is a tapped orifice and the elongate member is a threaded screw having an end for abutting against the side of the ski.

A related object of the present invention is to provide an apparatus for positioning a template on a ski, as described above, wherein the means for supporting includes a support plate and a contact plate including the previously mentioned outer side surface, preferably wherein the means for supporting or support is adapted for lateral displacement with respect to the outer side surface of the contact plate, and wherein the support plate and the contact plate are provided with a guide assembly for controlling such lateral displacement. The guide assembly preferably includes a transverse guide slot provided in the support plate, a receptacle for receiving a guide member provided in the contact plate, and a guide member fitted through the slot and adapted to be tightened in the receptacle to secure the support plate and the contact plate in a selected position and to be loosened to permit the support plate to move relative to the contact plate. Preferably, the support plate has a bottom surface with ribs and the contact plate has a top surface with grooves, wherein the ribs and the grooves are complementary and of substantially constant pitch and extend perpendicularly with respect to the slot and are adapted to mate when the guide member is tightened. Preferably, the guide member is a threaded screw and the receptacle is a tapped orifice.

Another related object of the present invention is to provide an apparatus for positioning a template on a ski, as described above, wherein both the support plate and the contact plate include the previously mentioned outer side surface and an inner side surface, wherein the inner side surface and the outer side surfaces are provided with recesses adapted to receive an element of a tightening means associated with the template mounted on the apparatus.

It is another object of the present invention to provide an apparatus for positioning a template on a ski, as described above, wherein the means for fastening includes a contact section attached to the connecting section adapted to cooperate with the lower surface of the support to fasten the apparatus to the ski, wherein the apparatus preferably also includes means for varying space between this contact section with respect to the lower surface of the support operably connected to the contact section and the connecting section to effect a gripping action. The means for doing so are preferably levers connected to the contact section and the connection section which extend laterally with respect to the exterior surface of the connecting section to form a grip or handle capable of being manipulated by hand.

It is yet another object of the present invention is to provide an apparatus for positioning a template on a ski, as described above, which also includes means for enhancing the gripping action of the apparatus attached to at least one of the lower surface of the support and the contact section, wherein the means for enhancing has a coefficient of friction higher than the coefficient of friction of the lower surface of the support and the contact section. The element preferably includes at least one joint or seal made of resilient material connected to the lower surface of the support adapted to press against a top surface area of a ski, as well as a friction pad adhered to the contact section adapted to press against a bottom surface area of the ski.

BRIEF DESCRIPTION OF THE DRAWINGS

Other aspects and advantages of the present invention will become clear from the detailed description which follows of certain preferred embodiments of the invention, given by way of non-limiting example with reference to the annexed drawings in which:

FIG. 6 is a top view of an annexed embodiment applicable to the previous embodiments; and FIG. 7 is a side view of an alternative of the invention.

DESCRIPTION OF PREFERRED EMBODIMENTS

The present invention attempts to overcome the previously mentioned disadvantages of manually determining the screw-hole placement for bindings by providing an accessory or piece of equipment to make it possible to adapt conventional templates used in connection with more conventional skis for the mounting of bindings on relatively wider monoskis.

To this end, the present invention relates to means for adapting a conventional binding mounting template for temporary placement on a monoski for the purpose of referencing the positioning of the mounting screws of the set of bindings. The means for adapting in accordance with the present invention is characterized in that the inventive adaptation device includes a plate having two parallel edges separated by a distance substantially equal to the width of a conventional cross-country or downhill-type ski, and means for immobilizing the plate on the upper surface of the monoski by abutting against one lateral edge of the monoski and by gripping the thickness of the monoski in the region of the lateral edge such that the parallel edges of the plate extend in the longitudinal direction of the monoski.

In a preferred manner, the means for immobilizing the plate includes an elastically deformable arm extending beneath the monoski from one of the parallel surfaces and cooperating with the lower surface of the plate to perform the gripping action, the gripping force being the elastic return force of the arm.

The invention also relates to a method for mounting a set of bindings for boots on a monoski which involves the steps of: immobilizing two adaptation devices of the type described above on one edge of the monoski at a predetermined distance from one another in a longitudinal direction; mounting a template designed to be used for mounting a set of bindings on a conventional cross-country or downhill ski including a horizontal plate provided with openings and means for gripping the plates of the adaptation elements at either end wherein the means for gripping fits around the parallel edges of the horizontal plate of the template to permit a scoring of the upper surface of the monoski through at least some of the openings; removing the template and the adaptation devices from the monoski; providing holes of a given depth and diameter on the upper surface of the monoski in conformity with the scorings which have been made thereon; positioning a set of bindings on the ski and maintaining the set of bindings in a desired position by means for securing, such as screws, engaged in the holes.

Figure 1:
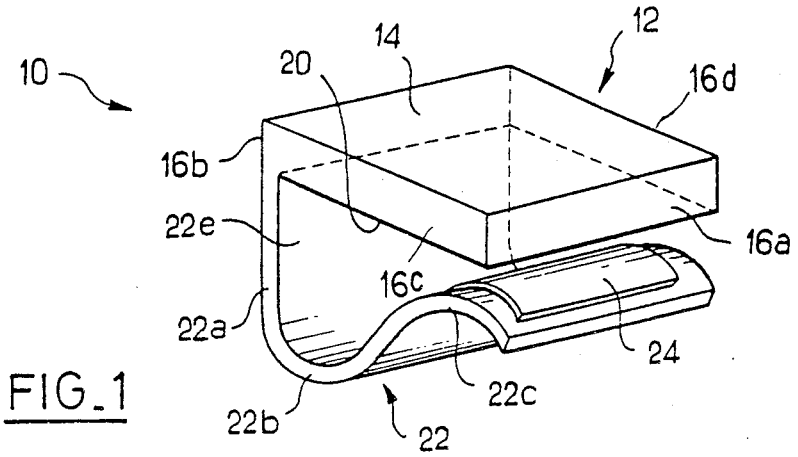
FIG. 1 is a perspective view of an adaptation device according to one basic embodiment of the present invention.

Referring to the annexed drawings and initially in reference to FIG. 1, an adaptation device according to the basic embodiment of the present invention is shown and is designated in its present entirely by reference numeral 10. Adaptation device 10 includes a parallelepipedic support or plate 12 of relatively substantial thickness as its upper portion. The plate 12 is laterally defined by two edges, i.e., interior edge 16*a* and exterior edge 16*b*, top surface 14 and bottom surface 20.

In the present embodiment, the adaptation device 10 also includes an extension or arm 22 having the general shape of an S, which is preferably integral or of one piece with plate 12.

The arm 22 includes a connection portion 22*a* extending substantially vertically downwardly as an extension of the exterior edge 16*b* of plate 12 and having an abutment surface 22*e* facing towards the interior of the device, a curved portion 22*b* having a generally U-shaped section turning upwardly towards the vicinity of bottom surface 20, and an end portion 22*c* of reverse curvature biased against the lower surface 20 to form a grip, as discussed in more detail below. In the present embodiment, the convex surface of the end portion 22*c* or gripping part of the arm which faces lower surface 20 of the plate, is provided with a coating 24 composed of a material having an appropriate coefficient of friction, for example perforated rubber, to prevent slipping or sliding.

The adaptation device 10, at least with respect to arm 22, is preferably formed out of material provided with a certain elasticity or resiliency. Also, the vertical distance between the lower surface 20 or the plate and the end portion 22*c*, when the arm is at rest, is selected to be less than the thickness of a monoski in its median portion. In this way, the positioning of the adaptation device on the edge of such a monoski, requiring the end portion or gripping part 22*c* to be forced to part away from lower surface 20 of the plate, will serve to cause an elastic return force between these two regions thereby assuring the gripping of the ski in its thickness. The anit-skid coating 24 enhances this gripping action by serving to immobilize the adaptation element on the ski in the selected position.

Figure 2:
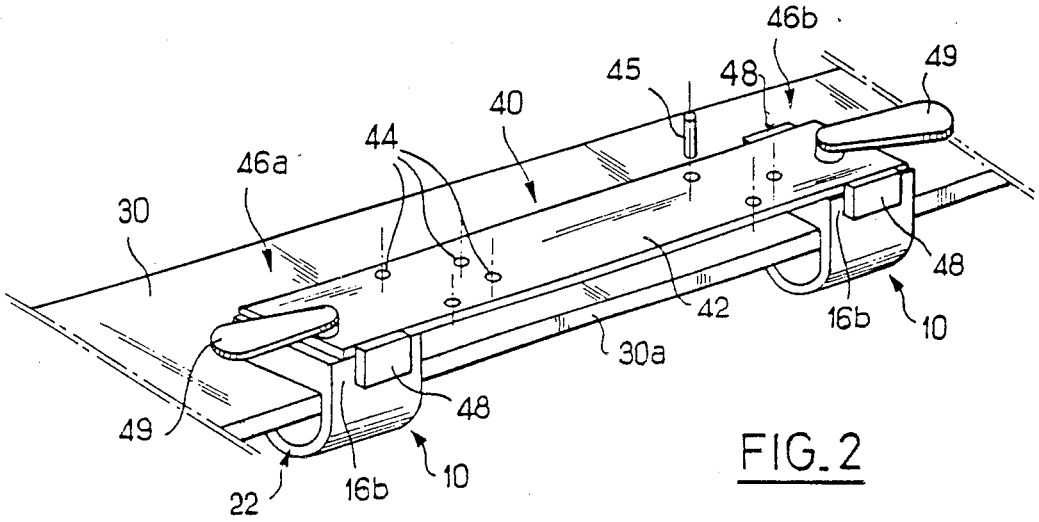
FIG. 2 is a partial perspective view of a monoski on which are temporarily mounted two adaptation devices according to FIG. 1, as well as a template.

In FIG. 2, two adaptation devices 10 have been positioned as described above around a lateral side 30*a* of a monoski 30 at a certain longitudinal distance from one another. It should be noted that the interior surface 22*e* of vertical portion 22*a* of arm 22 acts as an abutment for edge 30*a* of ski 30 during the positioning, so as to assure the correct positioning of adaptation devices 10 with respect to the ski in a transverse direction. A template 40 is also shown, in a schematic fashion, as including a plate 42 in which a plurality of openings 44 of well-defined diameters and predetermined positions are formed. A gripping device, composed of elements 46*a* and 46*b*, for example of the type described in French Pat. No. 2 240 751 and in French Utility Certificate No. 2 511 906, respectively, commonly owned with the present application, the disclosures of which are hereby incorporated by reference thereto, are located at each longitudinal end of the plate for the temporary attachment of the template.

Schematically, each element 46*a* and 46*b* of the transverse grip is composed of two rigid projections or ears 48 extending downwardly and adapted to be brought together or spaced from one another in a transverse direction by manipulation of lever 49. The ears 48 of the gripping devices normally cooperate with the lateral edges of a conventional ski to temporarily fit the template on the ski during the binding mounting operation.

According to the present invention, however, the ears 48 of these gripping devices cooperate with the lateral edges 16*a* and 16*b* of each of the two adaptation elements, and the template, to adapt the template, without any further modification, for use in mounting a set of bindings to a monoski.

Figure 2A:
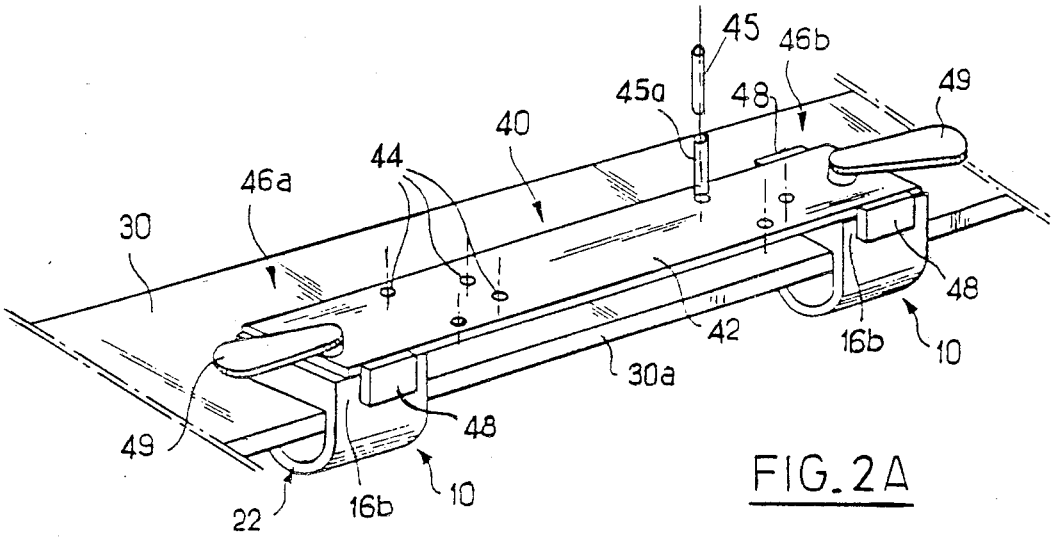
FIG. 2A is a view similar to that of FIG. 2 illustrating cylindrical guide 45*a;*

Once the template is fixed in the position shown, after possible adjustment of its longitudinal position with respect to the appropriate reference lines, one then uses a punch 45 inserted to at least some of the openings 44 of plate 42 to score or otherwise mark the upper surface of the monoski. Preferably, so as to assure that the punch is vertically oriented during this operation, each opening 44 is capped with a cylindrical guide 45*a*, schematically shown in FIG. 2A as having a longitudinal axis perpendicular to a longitudinal axis of a horizontal plane of the plate. In this way, one is able to minimize possible errors due to the relatively large vertical distance, substantially equal to the thickness of plate 12 of the adaptation devices, which exist between the lower surface of plate 42 of the template and the upper surface of ski 30, as a result of the attendant spacing of the template off the ski due to the use of the adaptation devices.

Subsequently, these operations are repeated on the other side of the monoski. After the template and the adaptation device are removed, the monoski is bored at the locations indicated by the scoring to form mounting holes having predetermined diameters and depths. The two sets of bindings can then be mounted in place by means of screws engaged in the holes which have been bored in the monoski.

Figure 3:
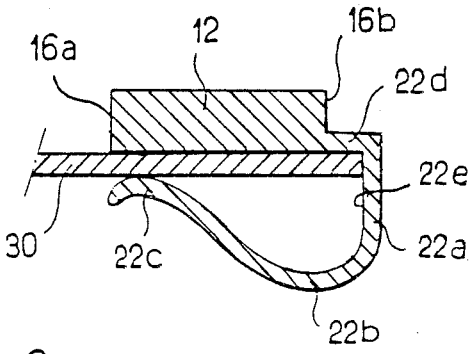
FIG. 3 is a transverse cross-sectional view of one adaptation device according to a first alternative embodiment of the invention, mounted on a monoski.

FIG. 3 illustrates an embodiment of the invention which makes it possible, for example, to adapt the template for use on a monoski wider than what is considered a regular monoski. In this regard, it should be pointed out that the position of the two sets of bindings on a monoski is predetermined, not only with respect to the lateral edges of the monoski, but also and particularly with respect to the median axis of the monoski. Thus, for a wider monoski, the binding must be located more towards the inside or in a central position with respect to the lateral edges of the monoski. According to this embodiment, therefore, the gripping arm 22 includes a horizontal linkage portion **22*d* which is connected, preferably in an integral fashion, with the top of connection portion 22*a* such that the lower surface of linkage portion 22*d* forms an essentially right angle with the interior abutment surface 22*e* of the arm. The lateral edges 16*a* and 16*b* of plate 12 are thus laterally offset away from the interior surface 22*e* with respect to a reference position as defined by the vertical interior abutment surface of part 22*a*** on which the lateral edge of the ski rests.

Figure 4A:
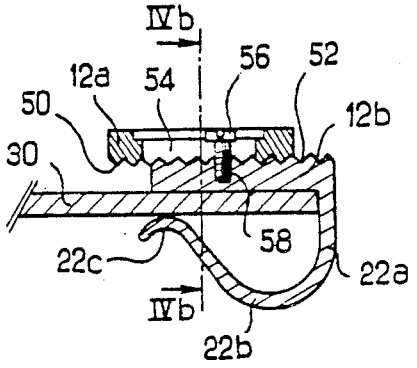
FIG. 4*a* is a transverse cross-sectional view of an adaptation device according to a second alternative embodiment of the invention, mounted on a monoski.
Figure 4B:
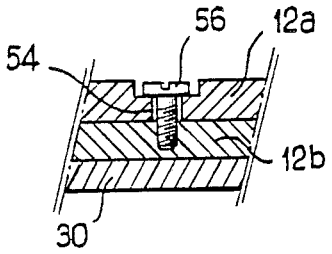
FIG. 4*b* is a cross-sectional view along line IV*b*—IV*b* of FIG. 4*a;*

FIGS. 4A and 4B illustrate another embodiment of the adaptation device which includes means for adjusting of the position of the lateral edge surfaces **16*a* and 16*b* with respect to the lateral edge of ski 30, to easily and rapidly adapt the adaptation device to different types and widths of monoskis. In this embodiment, plate 12 is composed of two half-plates, i.e., upper plate half or plate element 12*a* and lower plate half or plate element 12*b*. The upper plate element 12*a* is provided with ribs 50 which are longitudinally oriented with respect to the ski, preferably having a triangular cross-section and being of constant pitch, on its lower surface, while the lower plate element 12*b* has triangular grooves 52 which are complementary to ribs 50 on its upper surface. The lower plate element 12*b* is preferably formed of a single piece to be integral with vertical portion 22*a* of arm 22** with which it grips the ski in essentially the same manner as described above.

The upper plate element is also provided with a groove or slot 54 which extends through a portion of upper plate element **12*a* transversely with respect to the longitudinal axis of the ski. The slot 12 has a generally T-shaped transverse cross-section which is adapted to the shape of a tightening or set screw 56. As illustrated in FIG. 4B, the cross-section of the slot is shown as including a lower narrower portion to permit passage of the threaded portion of the screw. The lower narrower portion opens into an upper wider area which is countersunk with respect to the upper surface of the plate element 12*a* to seat the head of the screw such that the top side of the screw head is flush with the upper surface of plate element 12*a* when the threaded portion of the screw is fully inserted into a complementary tapped hole or receptacle 58 in a middle region of lower plate element 12*b*. It is, therefore, possible to lift the plate element 12*a* slightly off lower plate element 12*b* which supports it by unscrewing screw 56 and to offset upper plate element 12*a* perpendicularly with respect to the longitudinal direction of the ski, so as to bring its lateral surfaces 16*a* and 16*b* into a desired position which defines the position of the template in the transverse direction. Once this position has been reached, set screw 56** is tightened, and a similar adjustment operation is performed on the other adaptation device, so that the template can be placed into a desired position with respect to the lateral edges of the ski.

Figure 5:
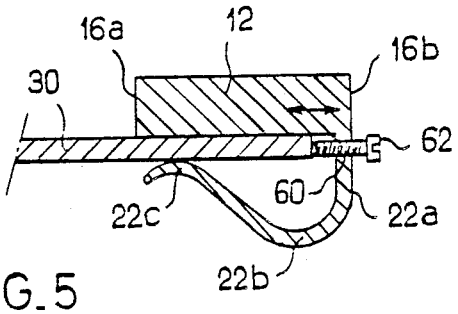
FIG. 5 is a transverse cross-sectional view of a third embodiment of the invention.

FIG. 5 illustrates a related embodiment which is a simplified alternative to the previously described embodiment which allows for the lateral adjustment of edges **16*a* and 16*b* with respect to the lateral sides of the ski. This alternative embodiment is essentially the same as the basic embodiment of FIG. 1, except that the vertical portion 22*a* of arm 22 is provided in its upper region with a tapped hole 60 having a horizontal axis for receiving an adjustment screw 62. By screwing and unscrewing the adjustment screw 62, one is able to vary the support point between the edge of the ski and the adaptation device 10 and consequently the position of surfaces 16*a* and 16*b***.

Another related embodiment of the present invention is a combination of the features of the adaptation device 10, as shown in FIGS. 3 and 5, so as to position the surfaces even further towards the center position away from the sides of the monoski.

FIG. 6 illustrates a modification which can preferably be applied to any one of the previously described embodiments. In this regard two recesses or reinforcements 70 provided in the region of the middle of the lateral edges **16*a* and 16*b* in which ears 48** of the template are inserted so as to wedge the ears to enhance their gripping. Such a modification makes it possible to facilitate the mutual positioning of the template and the adaptation device.

The adaptation device 10, shown in the embodiment of FIG. 7 has, as in the preceding cases, an upper plate 12 and an elastic grip arm 22. Preferably, plate 12 and arm 22 are laterally extended away from the side of the monoski by a handle 80 composed of two levers 81 and 82 which are, respectively, connected to plate 12 and arm 22. For example, these two levers may be formed integrally as a single piece with the plate or arm to which they are associated, and each of these elements extends laterally away from the ski. In particular, lever 82 returns elastic arm 22 as an extension laterally away from the side of the ski. In the normal or rest position, the two levers 81 and 82 are spaced from one another, but at a distance which makes it possible for the levers to be gripped simultaneously by the hand of the user. As the levers of the handle are squeezed together elastic arm 22, and more precisely its gripping portion **22*c*, becomes spaced apart with respect to a lower surface 20 of plate 12. The adaptation device 10 can then be engaged on the lateral side of the monoski. The release of the two levers 81 and 82 results in a tightening of the adaptation device on the ski. A standard or conventional template, such as template 40, can thus be adapted to the adaptation device 10 in a manner consistent with the discussion of the previous embodiments. The retraction of adaptation device 10 with respect to the monoski occurs in a manner similar to its engagement by tightening and then releasing the two levers 81 and 82 of handle 80**.

Plate 12, as shown in FIG. 7, may be provided at the level of its lower surface two joints or seals 83 and 84 which project downwardly. The seals are preferably made of elastic material, such as rubber or the like, having a coefficient of friction so as to prevent the sliding of the adaptation element once it is engaged on the monoski.

Of course, the present invention is not limited to the embodiments shown and described, and one of ordinary skill in the art can add to it or modify it without going beyond the scope of the invention. In particular, the term "monoski" employed throughout the description is intended to be taken in its larger sense, it being understood that the term also covers monoskis of the "snow surf" type of generally oblong shape. In this case, the conventional inclined position of the bindings with respect to the edges of the ski will be obtained by utilizing adaptation elements of appropriate geometry.

From the foregoing description, one skilled in the art can easily ascertain the essential features of this invention and, without departing from the spirit and scope thereof, make various changes and modifications of the invention to adapt it to various usages and conditions.

What is claimed is:

1. An apparatus for adapting a conventional template for temporary positioning on a monoski for purposes of marking positions of mounting screws of a set of bindings comprising:

a. a plate having two parallel edges separated by a distance substantially equal to a width of a conventional ski; and b. means for immobilizing said plate on an upper surface of a monoski adapted to abut against a lateral side of said monoski and grip a thickness in the region of said lateral side of said monoski, wherein said means for immobilizing comprises an elastically deformable arm extended beneath said plate from one of said parallel edges and cooperating with a lower surface of said plate to effect a gripping action, said apparatus further comprising a grip having two levers connected to said plate and to said arm such that drawing said two levers towards each other causes the spacing of said arm with respect to said plate to vary.

2. The apparatus for positioning a template on a ski in accordance with claim 1, further comprising means for enhancing said gripping action attached to at least one of said lower surface of said plate and said arm.

3. The apparatus for positioning a template on a ski in accordance with claim 2, wherein said means for enhancing is an element having a coefficient of friction higher than the coefficient of friction of said lower surface of said plate or said arm.

4. The apparatus for positioning a template on a ski in accordance with claim 3, wherein said element includes at least one seal made of resilient material connected to said lower surface of said plate adapted to press against a top surface area of a ski.

5. The apparatus for positioning a template on a ski in accordance with claim 3, wherein said element includes a friction pad adhered to said arm adapted to press against a bottom surface area of a ski.

* * * * *